United States Patent [19]

Safrit et al.

[11] 4,237,707

[45] Dec. 9, 1980

[54] DRESS WEIGHT TUBE SOCK WITH MOCK RIB LEG AND METHOD OF KNITTING

[75] Inventors: Sam C. Safrit, Pfrafftown; Harper Shields; William H. Coble, both of Burlington; Roscoe M. Farrell, Pittsboro, all of N.C.

[73] Assignee: Kayser-Roth Hoisery, Inc., Burlington, N.C.

[21] Appl. No.: 49,610

[22] Filed: Jun. 19, 1979

Related U.S. Application Data

[63] Continuation-in-part of Ser. No. 939,262, Sep. 7, 1978, abandoned.

[51] Int. Cl.[3] ..... D04B 9/46; A41B 11/02

[52] U.S. Cl. ..... 66/172 E; 66/185; 66/186

[58] Field of Search ..... 66/185, 186, 187, 188, 66/172, 172 E, 178, 178 A, 190, 194; 2/239

[56] References Cited

U.S. PATENT DOCUMENTS

| | | | |
|---|---|---|---|
| 1,211,247 | 1/1917 | Scott | 66/188 |
| 2,144,563 | 1/1939 | Davis | 66/182 |
| 2,183,862 | 12/1939 | Davis | 66/194 |
| 2,188,241 | 1/1940 | Davis | 66/180 |
| 2,238,353 | 6/1941 | Wientraub et al. | 66/172 E |
| 2,276,953 | 3/1942 | Fregeolle | 66/172 E |
| 2,306,246 | 12/1942 | Davis | 66/172 E |
| 2,315,119 | 3/1943 | Green | 66/172 E |
| 2,357,506 | 9/1944 | Davis | 66/172 E X |
| 2,473,677 | 6/1949 | Crawford et al. | 66/190 X |
| 2,739,407 | 3/1956 | Stern | 66/188 |
| 3,122,906 | 3/1964 | Crawford | 66/172 E |
| 3,162,029 | 12/1964 | Law et al. | 66/172 E |
| 3,187,522 | 6/1967 | Knohl | 66/186 |
| 3,241,340 | 3/1977 | Knohl | 66/185 |
| 3,386,270 | 6/1968 | Simmons | 66/188 |
| 3,425,246 | 2/1969 | Knohl | 66/185 X |
| 3,546,900 | 12/1970 | Knohl | 66/187 X |
| 3,796,067 | 3/1974 | East | 66/194 X |

*Primary Examiner*—Ronald Feldbaum

*Attorney, Agent, or Firm*—Bell, Seltzer, Park & Gibson

[57] ABSTRACT

One embodiment of this tube sock includes clearly defined and distinct tuck stitch type mock ribs completely arund the leg and in the instep. In another embodiment, the tuck stitch type mock ribs are formed around the front of the leg while the usual type of plain stitch mock ribs are formed around the rear of the leg. In both embodiments, the sock is of a medium or dess weight so that the sock may be comfortably worn with dress shoes and includes very long and fine terry loops in the heel and sole area to provide the sock with cushion and comfort characteristics of the type normally provided in heavy weight athletic type socks. Both embodiments of the sock are provided with partial additional or extra courses of elastic yarn in the heel area to provide the heel with additional stretch to provide a better fit on the heel of the wearer.

25 Claims, 13 Drawing Figures

DRESS WEIGHT TUBE SOCK WITH MOCK RIB LEG AND METHOD OF KNITTING

REFERENCE TO RELATED APPLICATION

The present application is related to applicants' co-pending application Ser. No. 939,261, filed Sept. 7, 1978, now U.S. Pat. No. 4,172,370 and is a continuation-in-part of applicants' co-pending application Ser. No. 939,262, filed Sept. 7, 1978 now abandoned.

FIELD OF THE INVENTION

This invention relates to a dress weight tube sock with a mock rib leg and to the method of knitting this type of sock on a circular hosiery knitting machine.

BACKGROUND OF THE INVENTION

Our co-pending application Ser. No. 939,261 discloses a medium or dress weight sock which may be comfortably worn with dress shoes and wherein fine terry loops are provided in the heel and sole area to provide the sock with the cushion and comfort characteristics of the type normally provided in heavy weight athletic type socks. This sock is knit on a fine gauge ladies' hosiery circular knitting machine of the type normally provided with approximately 400 latch needles and the sock is knit on alternate needles so that it contains only about 200 wales instead of the normal 400 wales contained in ladies' sheer hosiery articles of the type normally knit on this type of machine. The terry loops formed in the heel and sole area are formed on dial instruments projected outwardly over the idle needles so that unusually long terry loops are formed of a fine staple absorbent yarn with the terry loops being formed at least three to five times or more as long as the stitch loops formed of the body yarn to provide a very fine and lightweight "cushion" along the lower portion of the foot of the wearer.

The sock disclosed in out co-pending application Ser. No. 939,261 has the cushion and comfort characteristics of an athletic sock and is of sufficiently light weight that it may be worn with dress shoes. However, the leg of this sock does not have the ribbed appearance which is characteristic of most dress socks. Also, the amount of stretch in the heel area is the same as the amount of stretch in the remainder of the sock because the sock is knit with full complete courses throughout.

SUMMARY OF THE INVENTION

It is an object of the present invention to provide a dress weight tube sock having the advantages of the type non-rib sock disclosed in our co-pending application and which further includes elastic yarn inlaid in at least the leg and a portion of the instep to form mock ribs so that the sock has a ribbed appearance.

It is another object of this invention to provide a sock of the type described which is provided with a unique work rib construction resulting in greater and more definite rib definition, more closely approximating the appearance of true rib construction, and also characterized by having reduced or controlled stretchability compared to the usual type of mock rib construction.

Additionally, it is an object of this invention to provide a dress weight tube sock of the type described constructed to provide a rib appearance in the leg and wherein the front portion of the sock is provided with limited stretchability and the rear portion of the sock which is adapted to fit over the curved enlarged calf of the leg of the wearer is provided with greater stretch characteristics for a more comfortable uniform fit, leg conformity and neatness of appearance. To this end, we utilize the unique mock rib construction in the front portion of the sock to conform to the relatively straight front portion of the leg of the wearer, and in the rear portion of the sock we incorporate a conventional type of mock rib which is less clearly defined, but is more stretchable for conformity with the enlarged calf portion of the leg to provide maximum comfort and fit.

Another object of this invention is to provide in a tube sock of the type described having a terry heel area, an increased amount of fabric in the terry heel portion for greater stretch and elongation around the heel of the wearer for the purpose of better fit and to minimize the wrinkling which would otherwise be present on the front portion of the ankle opposite the heel. To this end, the heel area of the present sock is also provided with additional or extra partial courses knit of elastic yarn in the portion of the heel having terry loops.

In accordance with the present invention, elastic yarn is inlaid in spaced-apart wales of noncontiguous courses of the leg and forms mock ribs extending to the heel area. The elastic yarn is inlaid in spaced-apart wales of noncontiguous partial courses of at least the portion of the instep adjacent the heel area to form mock ribs therein and the elastic yarn extends from the instep area into the heel area and is knit in either every wale or every other wale to form additional or extra noncontiguous stretchable partial courses in the heel area. The heel area also includes full courses of body yarn which extend through the instep area and a nonstretchable auxiliary yarn knit it plated relationship with the body yarn throughout both the instep and heel areas with the auxiliary yarn forming unusually large or long terry loops on the inner surface of the heel area. The additional or extra partial courses of elastic yarn are interspersed with the courses having the long terry loops to provide increased fabric and stretch in the terry heel area so that the cushion heel area will readily conform to the configuration of the heel of the wearer. Preferably, terry loops are also formed in the sole area and may be formed in the lower portion of the instep area and toe pocket.

In one embodiment, the sock includes unusually well-defined and clear mock ribs of unique construction which are formed by knitting a body yarn while forming plain stitch loops in every wale of every other course and forming plain stitch loops of the body yarn in alternate wales while forming tuck loops in the intervening wales of the remaining courses. Thus, the fabric is provided with a course of plain stitches followed by a course of alternating plain stitches and tuck loops followed by a course of plain stitches, and a course of alternating plain stitches and tuck loops, continuing in that sequence with the tucks being in the same wales in each course where they occur. Consequently, alternate wales of the fabric contain only plain stitch loops while the intervening wales contain alternating plain stitches and tuck loops. An elastic yarn is inlaid in a wale having alternating plain stitches and tuck loops and is next inlaid in a noncontiguous wale having only plain stitches, and this sequence continues around the leg. Preferably, the elastic is inlaid in a first wale having plain and tuck stitches and thereafter in the fifth succeeding wale which has only plain stitches and the elastic yarn is floated inside of the four intervening wales to draw the fabric together and form the clearly defined tuck stitch mock ribs.

Because the elastic yarn is alternately inlaid in wales containing only plain stitches and wales containing plain stitches and tuck loops, the portions of the mock ribs adjacent opposite sides of the wales containing plain stitches and the tuck loops are drawn closer together than the portions of the mock ribs adjacent opposite sides of the wales containing only plain stitches. This drawing together of the fabric causes the formation of alternating steep valleys and shallow valleys between the outwardly projecting ribs so that the ribs are straight and unusually sharp and well-defined when the sock is relaxed.

In another embodiment of the sock, the mock ribs in the front portion of the leg are formed with the unique tuck loop construction described above with reference to the first embodiment. The mock ribs in the rear portion of the leg, the portion which covers the enlarged calf of the wearer, are knit in a manner known per se with plain body yarn stitches throughout and with elastic inlaid in spaced wales to form mock ribs without tuck loops. These two different types of mock ribs cause the rear half of the leg of the sock to have more fabric and greater stretchability than the front half. Thus, the greater amount of fabric in the rear portion of the leg causes the leg of the sock to be curved in a "banana" or "boomerang" shape when relaxed and provides a better and more comfortable fit when positioned on the leg of the wearer.

In each embodiment of the invention, the sock is knit with a stretchable synthetic hydrophobic body yarn such as a multifilament textured nylon, within the range of about 100 to 200 denier. The auxiliary yarn is a hydrophilic staple yarn, such as cotton or Orlon acrylic, and is plated on the inside of the stretchable nylon body yarn so that it is positioned against the foot and leg of the wearer to provide absorption and comfort while the nylon body yarn is positioned on the outer surface of the sock to provide wear resistance. The auxiliary yarn is preferably a lightweight staple cotton yarn within the range of about 40 to 60 single count, preferably a 50 single count cotton, and this fine cotton yarn forms the unusually long terry loops in the heel and sole areas. The elastic yarn is inlaid in the leg and instep and is knit to form additional or extra partial courses in the heel area. The elastic yarn is within the range of 70 to 240 denier spandex, preferably 180 denier, with a double wrapping of nylon.

BRIEF DESCRIPTION OF THE DRAWINGS

Other objects and advantages will appear as the description proceeds when taken in connection with the accompanying drawings, in which.

DESCRIPTION OF THE EMBODIMENT OF FIGS. 1-7

Figures 1, 2, 3, 4:
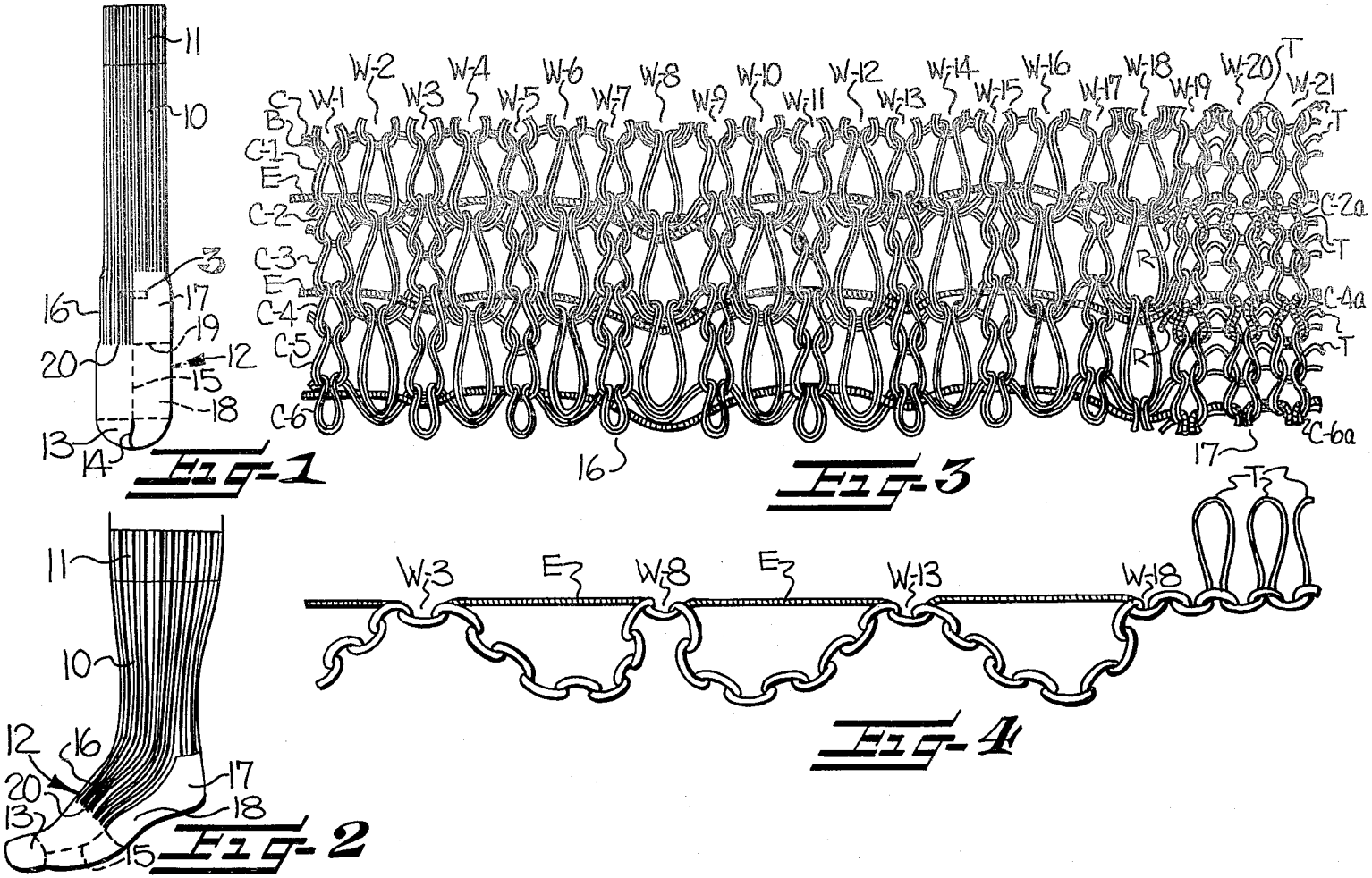
FIG. 1 is an elevational view of one embodiment of the sock in accordance with the present invention and in flattened condition.
FIG. 2 is a perspective view of the present sock as it appears when positioned on the foot of the wearer and showing how the mock ribs extend down over the upper portion of the instep.
FIG. 3 is a greatly enlarged fragmentary elevational view of a small portion of the fabric spanning a portion of the tuck stitch mock rib construction in the instep and illustrating the elastic yarn being knit in every wale to form partial courses in the heel area, being taken substantially in the area of the enclosed dotted rectangle 3 in FIG. 1.
FIG. 4 is a schematic horizontal sectional view of FIG. 3, illustrating the manner in which the elastic yarn draws the fabric together to form the mock ribs in the instep area and the formation of the long terry loops in the heel area.

As illustrated in FIG. 1, the sock includes a leg portion 10 having an upper elastic cuff 11 and a foot portion, broadly indicated at 12. The leg and foot portions contain about 180 to 200 wales and preferably contain 200 wales. The foot portion 12 includes a closed toe 13 which is illustrated as the well-known "fish mouth" type toe closed by a seam 14 extending around the toes of the wearer. The dotted line 15 indicates the circumferential division of the foot portion 12 into upper and lower portions with the upper portion defining an instep portion 16 and the lower portion defining a patch heel or area 17 and a sole area 18 extending between the heel area 17 and the toe 13. The dotted line 19 indicates the lower end of the heel area 17 and the upper end of the sole area 18 and it is preferred that terry loops be provided in the inner surface of the heel area 17, the sole area 18, the toe 13 and the lower portion of the instep 16, that portion below the line 20. The instep 16 extends adjacent the heel area 17 and sole area 18 and to the toe 13. The method of knitting the sock and forming the terry loops will be presently described.

Figure 5:
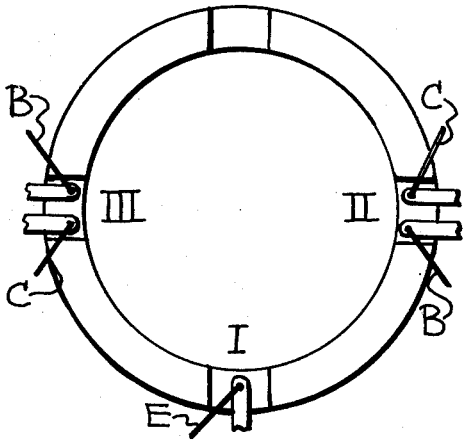
FIG. 5 is a schematic plan view of the needle cylinder of the knitting machine illustrating the feeding of the yarns at the knitting stations.

The cuff 11 may be of any of the well-known types of cuff which are normally formed on socks, either knee-high or ankle-high socks. The leg portion 10 and foot portion 12 are knit of a stretchable synthetic body yarn of about 100 to 200 denier, preferably 140 denier multifilament nylon which has been textured to impart stretch characteristics thereto, the body yarn being indicated at B in FIGS. 3 and 5. A nonstretchable auxiliary yarn of hydrophilic staple fibers, indicated at C in FIGS. 3 and 5, is knit in plated relationship with the body yarn B, throughout the leg portion 10 and throughout the portion of the instep 16 adjacent the heel area 17, down to the line 20. The auxiliary yarn C is preferably cotton of about 40 to 60 single cotton count, preferably a 50 single count cotton yarn.

The auxiliary yarn C is also knit in plated relationship with the body yarn B and forms terry loops T at least throughout the heel area 17 and sole area 18, as illustrated in the right-hand portion of FIG. 3 (wales W-19 through W-21). As illustrated, the yarns B and C are plated and form stitch loops in the needle wales while terry loops T are formed of the yarn C in the sinker wales and between the needle wales. The sock illustrated in FIG. 1 has the terry loops T also formed on the inner surface of the closed toe 13 and the lower portion of the instep 16, up to the line 20.

The unique tuck stitch mock ribs in the leg 10 and the upper portion of the instep 16 are formed by tuck loops of the body yarn B being positioned in selected wales and courses while an elastic yarn E (FIG. 3) is inlaid in selected noncontiguous wales and courses of the plated body yarn B and auxiliary yarn C. The elastic yarn E draws the fabric together to form the distinct and well-defined mock ribs. The elastic yarn E is within the range of 70 to 240 denier spandex, preferably 180 denier, with a double wrapping of nylon.

The tuck stitch mock ribs in the leg portion 10 are formed by the stitch construction illustrated in the left-hand portion of FIG. 3 (wales W-1 through W-18). As illustrated in FIG. 3, the body yarn B forms plain stitch loops in every wale of every other course (the odd numbered courses C-1, C-3, etc.) while being plated with the auxiliary cotton yarn C. The body yarn B and the plated cotton yarn C form plain stitch loops in alternate wales (the odd numbered wales W-1, W-3, etc.) while forming tuck loops in the intervening wales (the even numbered wales W-2, W-4, etc.) in the remaining courses (the even numbered courses C-2, C-4, etc.).

The elastic yarn E is inlaid in the courses (even numbered courses) in which the body yarn B forms the alternating plain stitches and tuck loops and is inlaid in every fifth wale (wales W-3, W-8, W-13, and W-18). The elastic yarn E floats inside the four intervening wales (such as wales W-4 through W-7) and draws the wales therebetween together, as schematically illustrated in FIG. 4, to form the tuck stitch mock ribs. The elastic yarn E is thus alternately inlaid in wales containing only plain stitches (wales W-3 and W-13) and in wales containing alternating plain stitches and tuck loops (wales W-8 and W-18). Because of the pattern of plain stitches and tuck loops of the body yarn B and the plated auxiliary yarn C, the portions of the mock ribs adjacent opposite sides of the wales containing plain stitches and tuck loops (wales W-8 and W-18) are drawn closer together and form deeper valleys than the valleys formed by the portions of the mock ribs adjacent opposite sides of the wales containing only plain stitches (wales W-3 and W-13).

As illustrated in FIG. 4, the valleys formed between the mock ribs where wales of plain stitch loops and tuck loops are formed (wale W-8) are much deeper than the valleys formed between the mock ribs where wales of plain stitches occur (wales W-3 and W-13). This results in a fabric having clearer, straighter, more definitely defined ribs, which more nearly simulate true rib construction. Moreoever, the combination of the plain loops and tuck loops decreases the amount of fabric, restricts and controls the amount of stretchability and results in a more stable fabric than the usual mock rib fabric which is generally more open and stretchable, particularly in the coarse gauge large loop fabric of athletic type socks. The fine gauge, small loops of the sock knit in accordance with this invention also contribute to the improved appearance and stability of the fabric.

The tuck stitch mock rib fabric illustrated in the left-hand portion of FIG. 3 is knit completely around the leg 10 of the sock and extends into the instep 16, down to the line 20. In the instep 16, the tuck stitch mock ribs extend around only the front portion of the sock. The inlaid elastic yarn E extends from the instep portion 16 (wales W-1 through W-18) and into the heel area 17 (wales W-19, W-20 and W-21 of FIG. 3) where it is knit in every wale to form stretchable noncontiguous additional or extra partial courses, as indicated by the partial courses C-2*a*, C-4*a* and C-6*a* which are present only in the heel area 17. It will be noted that the partial courses of elastic yarn E in the heel area 17 do not include terry loops while the courses of body yarn B between the partial elastic courses do include terry loops T formed of the auxiliary cotton yarn C. It is preferred that a reinforcing yarn R be knit in plated relationship with the elastic yarn E in the plain knit partial courses of the heel 17 to somewhat restrict the stretchability of the elastic yarn and for strength and wearability. The ends of the reinforcing yarn R are cut adjacent the opposite ends of the elastic yarn partial courses in the heel area 17.

Figures 3A, 4A:
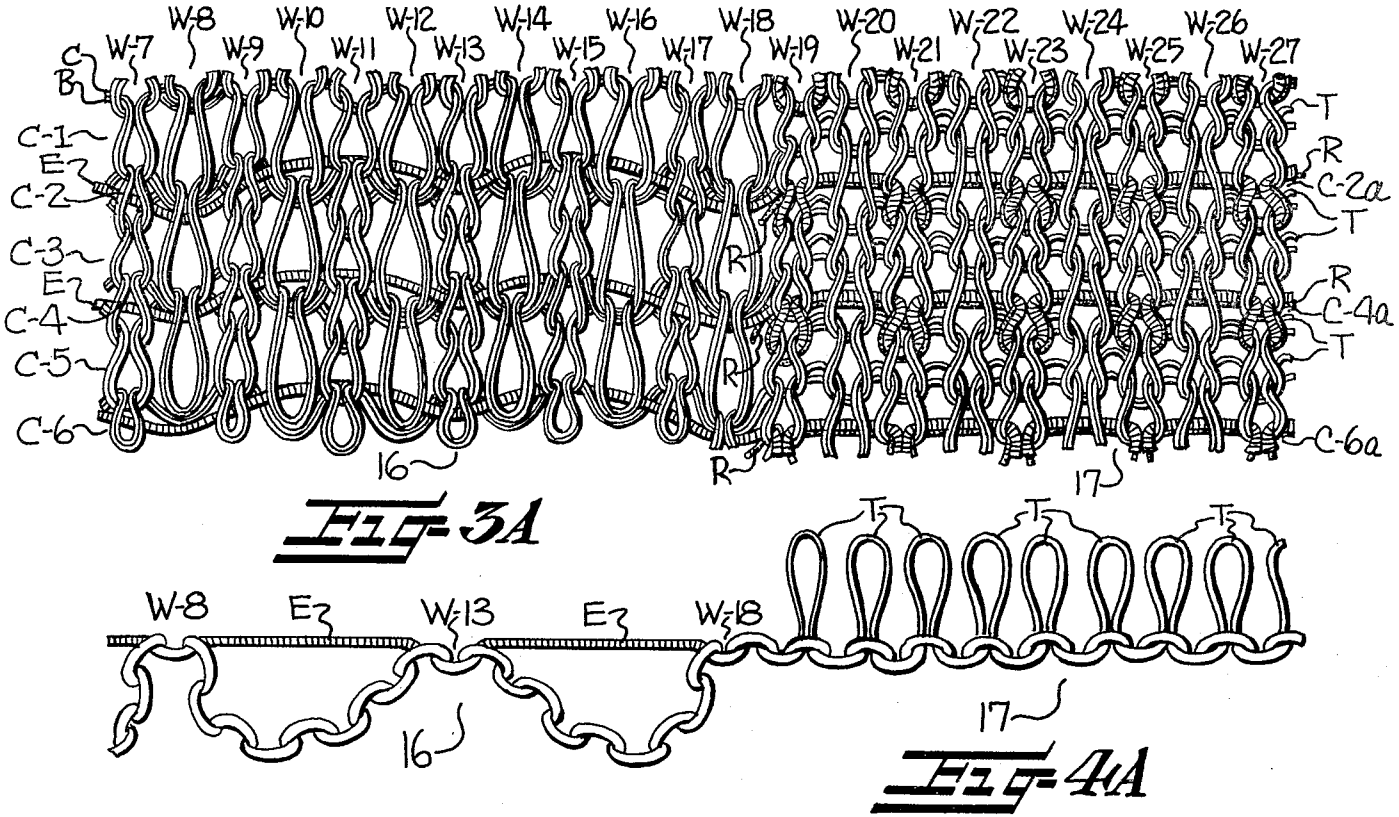
FIG. 3A is a view similar to FIG. 3 but illustrating the elastic yarn being knit in every other wale in the partial courses of the heel area.
FIG. 4A is a schematic horizontal sectional view of FIG. 3A.

The embodiment of the sock illustrated in FIGS. 3A and 4A is knit with the same yarns as the sock illustrated in FIGS. 3 and 4 and the corresponding yarns and portions of the sock bear the same reference characters. However, the elastic yarn E is knit in only every other wale (the wales W-19, W-21, W-23, W-25 and W-27 of FIG. 3A) in the partial courses C-2*a* and C-4*a* of the heel area 17 and not in every wale, as is the case in the sock of FIG. 3. Also, the elastic yarn E floats inside of the remaining wales (wales W-20, W-22, W-24 and W-26 of FIG. 3A) in the partial courses C-2*a* and C-4*a* of the heel area 17.

It is preferred that reinforcing yarn R be knit in plated relationship with the elastic yarn E in the partial courses C-2*a* and C-4*a* of the heel area 17. Thus, the reinforcing yarn R forms plated stitch loops with the elastic yarn E in the odd numbered wales of the heel area 17 and floats inside of the even numbered wales with the elastic yarn E.

The stretchable body yarn B and the auxiliary cotton yarn C are knit in the same manner in the sock of FIGS. 3A and 4A as they are knit in the sock of FIS. 3 and 4 to form a tuck stitch mock rib fabric in the instep 16 and to form partial courses of plain jersey stitch loops in the heel area 17 with the yarn C forming terry loops T in the sinker wales. The elastic yarn E is inlaid in spaced apart courses and spaced apart wales (wales W-8, W-13 and W-18) and floats inside of the remaining wales to draw the fabric together and form the clearly defined mock ribs, as illustrated in FIG. 4A.

METHOD OF KNITTING

The method of knitting the sock illustrated in FIG. 1 will be described, by way of example, as being knit on a fine gauge ladies' hosiery circular knitting machine normally provided with 400 latch needles of 75 gauge. There are many different types of fine gauge ladies' hosiery knitting machines presently in operation and the sock of the present invention can be knit on any of these types with very slight modifications. In the present instance, the sock will be described as being knit on an eight feed machine which has been modified to maintain every other needle in an inactive position so that only 200 needles knit at three knitting stations, the knitting stations being schematically shown in FIG. 5. The needle cylinder of this machine normally rotates at 275 rpm and two courses of body yarn and one elastic yarn inlay are formed with each rotation of the needle cylinder.

After formation of the cuff 11 on the 200 active needles, the needle cylinder continues to rotate throughout the knitting of the leg 10 while the body yarn B and the auxiliary cotton yarn C are both fed at knitting stations II and III (FIG. 5) while the elastic yarn E is fed at knitting station I. The body yarn B and the auxiliary cotton yarn C at knitting station III are fed to and knit on every active needle to form plain stitch loops in every wale with the yarns B and C in plated relationship, as illustrated in course C-1 and the remaining odd numbered courses in the left-hand portion of FIG. 3.

At station I, the elastic yarn E is fed to and picked up by the hook of every fifth active needle, such as the needles forming wales W-3, W-8, W-13 and W-18 of FIG. 3. The elastic yarn E is not knit by these needles but is held in the hooks and is floated behind or inside of the four active needles therebetween. The active needles which pick up the elastic yarn E are raised to the float level at station I and are not raised high enough that the stitch loops held thereon pass below the latches.

At station II, the body yarn B and the auxiliary yarn C are fed together to every active needle and plain knit stitch loops are formed on every other active needle, the needles forming the odd numbered wales in the left-hand portion of FIG. 3. The yarns B and C form tuck loops on the remaining active needles, the needles forming the even numbered wales in the left-hand portion of FIG. 3.

As illustrated in the left-hand portion of FIG. 3, the elastic yarn E is alternately inlaid in wales containing only plain stitches, such as wales W-3 and W-13, and wales containing alternating plain stitch loops and tuck loops, such as wales W-8 and W-18. This combination of the formation of a course of plain stitch loops and a course of plain stitch loops alternating with tuck loops while inlaying the elastic yarn in every fifth wale provides clear and well-defined tuck stitch mock ribs in the leg portion 10. The knitting of two courses of the plated body yarn B and auxiliary yarn C and in inlaying of the elastic yarn E continues with each rotation of the needle cylinder until a sufficient number of courses have been formed in the leg 10, down to the heel area 17 and instep area 16.

The needle cylinder continues to rotate to knit the heel area 17 and the instep area 16 and partial courses of the tuck stitch mock rib construction are formed on the 120 active needles which knit the front portion or instep area 16 of the sock while the 80 remaining active needles which knit the rear portion or heel area 17 are all raised to stitch forming level at all three knitting stations to form only plain stitch loops in the heel area 17. The plain stitch loops of the body yarn B and auxiliary yarn C are formed at the knitting stations II and III, as illustrated in wales W-19 through W-21 of FIG. 3. The auxiliary cotton yarn C is plated with the body yarn B in stitch loops formed in the needle wales but the yarn C forms terry loops T in the sinker wales between the needle wales. The elastic yarn E and reinforcing yarn R are plated and form extra or additional partial courses of plain stitch loops in the heel area 17 and at the knitting station T.

Figure 7:
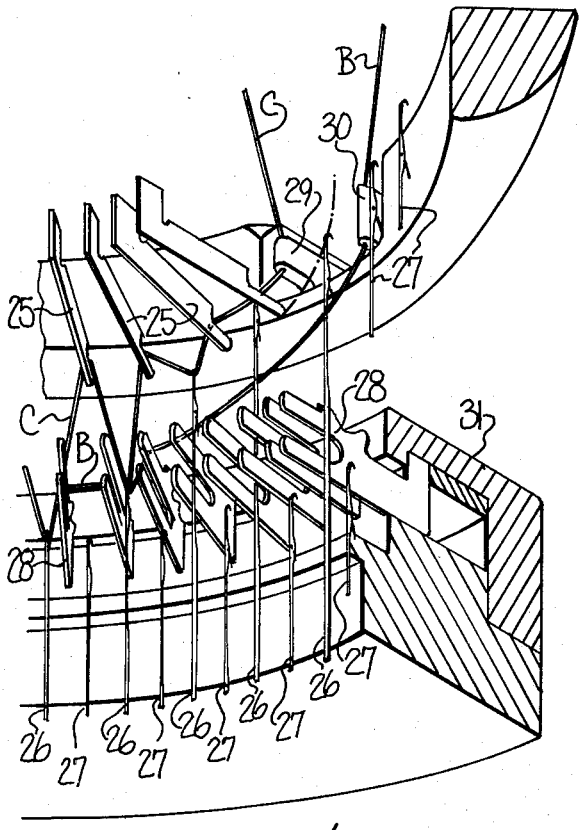
FIG. 7 is an enlarged, somewhat schematic isometric view looking up from the inside of the needle cylinder and showing some of the parts of the knitting machine adjacent one of the yarn feeding stations and illustrating the manner in which the long terry loops are formed over the dial instruments.

During the knitting of the heel area 17, dial instruments, indicated at 25 in FIG. 7, are projected or moved outwardly at knitting stations II and III to form terry loops in the partial courses of the heel area 17. The dial instruments 25 are mounted in a dial, not shown, positioned above the needle cylinder, not shown, and the dial instruments are movable radially around the outer circumference of the dial above the level of sinkers which are movable radially from the inner periphery of the sinker cap 31. A dial instrument 25 is aligned above each inactive needle, indicated at 27. The cotton auxiliary yarn C is fed through feed finger 29 and over the terry loop forming step on the outer end of the dial instrument 25 and forms a terry loop of the cotton yarn as the active needles 26 on opposite sides thereof pick up both yarns B and C and draw them down to stitch forming position, as illustrated in FIG. 7.

The body yarn B is fed through feed finger 30 and in advance of the cotton yarn C so that it does not pass over but is drawn down beneath the outer ends of the dial instruments 25 (FIG. 7). Thus, the body yarn is drawn down over a pair of adjacent sinkers 28 and above an inactive needle 27. The distance between the terry loop forming outer end of the dial instrument 25 and the stitch forming ledge of the sinker 28 is on the order of about 5/16 of an inch so that the terry loops are formed much longer than could be formed if the terry loops were formed in the usual manner, over the nibs of the sinkers. This spacing of the terry loop forming outer end of the dial instruments 25 above the stitch forming ledge of the sinker 28 is sufficient that the terry loops T (FIG. 6) are drawn at least three to five times as long as the stitch loops formed of the plated body yarn B and the cotton auxiliary yarn C.

Also, during the knitting of the heel area 17, the 80 active needles which knit this area are raised at knitting station I to pick up and form knit stitch loops of the elastic yarn E to form the extra or additional partial courses indicated at C-2*a*, C-4*a* and C-6*a* in FIG. 3. During the knitting of the heel area 17, it may be desired to feed the reinforcing yarn R to the active needles with the elastic yarn E so that they are knit in plated relationship, as indicated in wales W-19, W-20 and W-21 of FIG. 3. The reinforcing yarn R is removed and cut at opposite ends of the partial courses of elastic yarn E so that the reinforcing yarn R does not extend through the instep 16.

Figure 6:
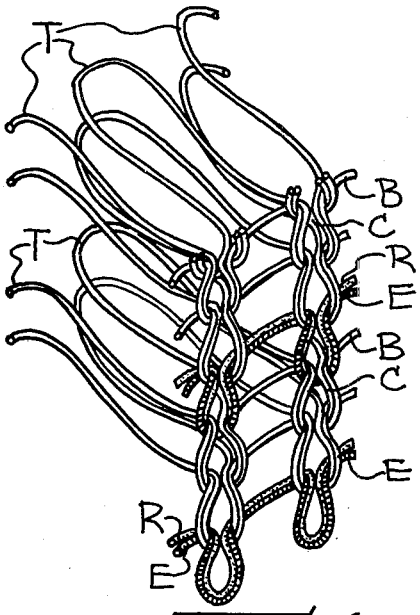
FIG. 6 is an enlarged isometric view of a pair of wales in the heel area and illustrating the manner in which the long terry loops extend inwardly on the inner surface of the heel.

The fragmentary view of the fabric shown in FIG. 6 clearly illustrates the manner in which the cotton auxiliary yarn C is plated with the body yarn B in the needle wales and the cotton yarn C forms terry loops T in the sinker wales of the heel area 17. FIG. 6 also illustrates the formation of the additional or extra partial courses of the elastic yarn E with the reinforcing yarn R in plated relationship therewith.

Upon completion of the knitting of the heel 17 and the upper portion of the instep 16, at the lines 19 and 20, the sole portion 18 and the lower portion of the instep 16 are knit with continuous rotation of the needle cylinder. The elastic yarn E is removed from the knitting position at knitting station I and body and auxiliary yarns are moved to knitting position at station I with all active needles picking up and knitting both yarns in plated relationship. The dial instruments are also moved out at knitting station I so that the sole 18 and lower portion of the instep 16 are knit with plain stitch loops at each knitting station to form a plain knit fabric with the cotton yarn C plated on the inside, the nylon body yarn B plated on the outside, and the cotton yarn C forming terry loops T completely around the sole 18 and lower portion of the instep 16. Since both yarns B and C are knit at each knitting station, three full courses are knit with each rotation of the needle cylinder. The toe portion 13 is also knit in the same manner with the long fine terry loops being formed on the inner surface of the toe 13. Upon completion of the knitting of the toe 13, the sock is open at the lower end and the seam 14 is formed to close the toe.

The embodiment of the sock illustrated in FIGS. 3A and 4A is knit in generally the same manner as the sock of FIGS. 3 and 4 except that the elastic yarn E and reinforcing yarn R being fed at station I are both fed to and knit on only every other needle to form stitch loops in only every other wale of the heel area 17 (wales W-19, W-21, W-23, W-25 and W-27 of FIG. 3A). The elastic yarn E and reinforcing yarn R are both floated inside of the remaining needles in the heel area 17 so that these yarns are floated across and inside of the remaining wales (wales W-21, W-22, W-24 and W-26 of FIG. 3A).

By knitting the present sock on a ladies' fine gauge hosiery knitting machine, the yarns are actually knit on fine gauge needles (75 gauge) which are spaced much wider apart than is normal for this gauge needle. This wider than normal spacing of the needles is provided because every other needle remains in an inactive position (or the inactive needles can be removed from the machine). The present sock is knit on fine gauge needles which are spaced according to the spacing normally provided between the needles of a medium or coarse gauge machine. Thus, when initially formed, relatively short and narrow stitch loops are formed in each needle wale and the sinker wales are very wide. The stitch loops in the needle wales are spaced much wider apart than normal for this size of stitch loop because the sinker wales are formed by drawing the yarn down over a pair of adjacent sinkers which are positioned on each side of an inactive needle.

One would normally assume that this type of knitting would produce an open, lacy or sleazy type of fabric. Surprisingly, however, this has not proved to be the case and the combination of the staple nonelastic yarn with the stretchable nylon yarn knit in accordance with this invention results in a sock having a very smooth, even, uniform appearance. The abnormally wide sinker wales provide a greter than normal spacing between needle wales so that a greater proportional length of stretchable nylon body yarn extends in a coursewise direction when initially knit. The coursewise extending stretchable nylon body yarn can relax and contract with less restriction than would be possible if a stitch loop were formed in this space.

The plating of the cotton yarn C on the inner surface of the sock and the nylon body yarn B on the outer surface provides the absorption and comfort of cotton against the foot and leg of the wearer and provides the wear resistant characteristics of the nylon on the outer surface. The terry loops in the heel and sole areas provide a lightweight cushion which is very comfortable beneath the heel and foot of the wearer while the overall thickness, bulk, and weight of the sock is not sufficient to cause the foot to be uncomfortable or feel cramped in a dress shoe. Also, the tuck mock ribs in the leg and instep provide the sock with the ribbed appearance usually found in socks worn with dress shoes.

DESCRIPTION OF THE EMBODIMENT OF FIGS. 8–11

Figure 8:
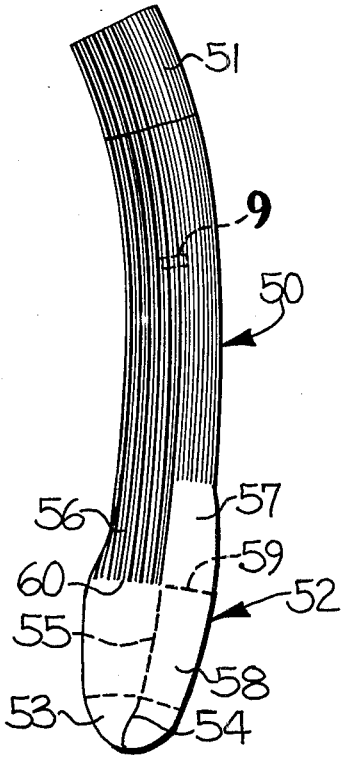
FIG. 8 is an elevational view of another embodiment of the sock in accordance with the present invention and in flattened condition.

As illustrated in FIG. 8, this embodiment of the sock includes a leg portion broadly indicated at 50 having an upper elastic cuff 51 and a foot portion, broadly indicated at 52. The leg and foot portions contain about 180 to 200 wales and preferably contain 200 wales. The foot portion 52 includes a closed toe 53 which is illustrated as the well-known "fish-mouth" type toe closed by a seam 54 extending around the toes of the wearer. The dotted line 55 indicates the circumferential division of the foot portion 52 into upper and lower portions with the upper portion defining an instep 56 and the lower portion defining a patch heel or area 57 and a sole area 58 extending between the heel area 57 and the toe 53. The dotted line 59 indicates the lower end of the heel area 57 and the upper end of the sole area 58 and it is preferred that terry loops be provided in the inner surface of the heel area 57, the sole area 58, the toe 53 and the lower portion of the instep 56, that portion below the line 60. The instep 56 extends adjacent the heel area 57 and sole area 58 and to the toe 53. The method of knitting the sock and forming the terry loops will be presently described.

The cuff 51 may be of any of the well-known types of cuff which are normally formed on socks, either knee-high or ankle-high socks. The leg portion 50 and foot portion 52 are knit of a stretchable synthetic body yarn of about 100 to 200 denier, preferably 140 denier multifilament nylon which has been textured to impart stretch characteristics thereto, the body yarn being indicated at B in FIG. 9. A nonstretchable auxiliary yarn of hydrophilic staple fibers, indicated at C in FIG. 8, is knit in plated relationship with the body yarn B, throughout the leg portion 50 and throughout the portion of the instep 56 adjacent the heel area 57, down to the line 60. The cotton auxiliary yarn C is preferably cotton of about 40 to 60 single cotton count, preferably a 50 single cotton count yarn. The cotton auxiliary yarn C is also knit in plated relationship with the body yarn B and forms terry loops T at least throughout the heel area 57 and sole area 58. The terry loops are formed in the same manner as described in connection with the first embodiment of the sock.

The mock ribs in the leg 50 of the sock of FIG. 8 are of two different types. The mock ribs extending around the front portion of the leg include tuck loops and are of the type knit in the leg portion of the first embodiment of the sock, that is, where the body yarn B forms tuck loops in selected wales and courses while the elastic yarn E is inlaid in selected noncontiguous wales and courses, in the manner indicated in the left-hand portion of FIG. 9 (wales W-1 through W-18). The rear portion of the leg 50, that portion aligned above the heel patch or area 57, is knit in the usual manner of forming mock ribs, that is, by knitting the body yarn B in plain stitch loops in every course and inlaying the elastic yarn E in selected noncontiguous wales of alternate courses, in the manner indicated in the right-hand portion of FIG. 9 (wales W-19 through W-28).

Figure 9:
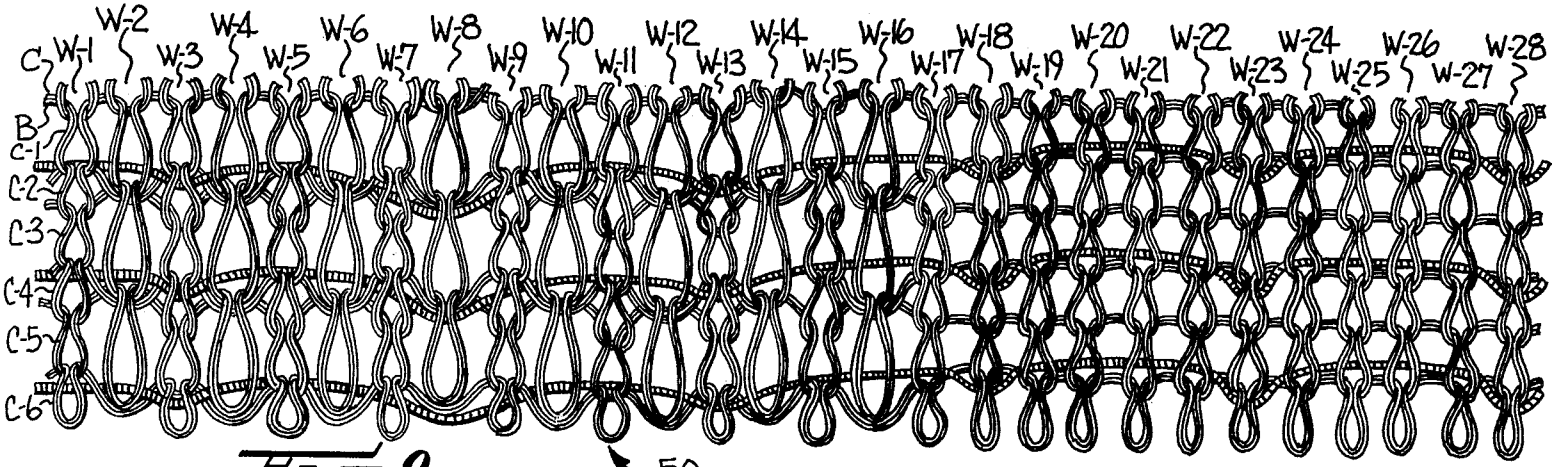
FIG. 9 is a greatly enlarged fragmentary elevational view of a small portion of the fabric spanning the two types of mock ribs formed in the leg portion and being taken in the area of the dotted rectangle 9 in FIG. 8.

The tuck stitch mock rib stitch construction is illustrated in wales W-1 through W-18 of FIG. 9 and extends around the front portion of the leg 50 of the sock, preferably encompassing 120 of the 200 wales in the leg of the sock. The regular or conventional mock rib stitch construction is illustrated in wales W-19 through W-28 of FIG. 9 and extends around the remaining 80 wales at the rear of the leg 50. Because the body yarn forms tuck loops in every other course in the tuck mock rib front portion of the leg 50 while forming only plain stitch loops in every course around the plain mock rib rear portion of the leg 50, a greater amount of fabric is knit in the rear portion than in the front portion of the leg so that the leg is curved forwardly, as illustrated in FIG. 8, in a somewhat "banana" or "boomerang" shape. The plain stitch mock ribs around the rear portion of the leg also provide greater stretchability in the rear of the leg than in the front portion of the leg. Since the rear portion of the leg 50 covers the calf of the wearer and this portion of the leg is usually larger, the extra or additional fabric formed in the rear portion of the leg and the greater stretchability provides a better and more comfortable fit when positioned over the calf of the wearer.

Figure 10:
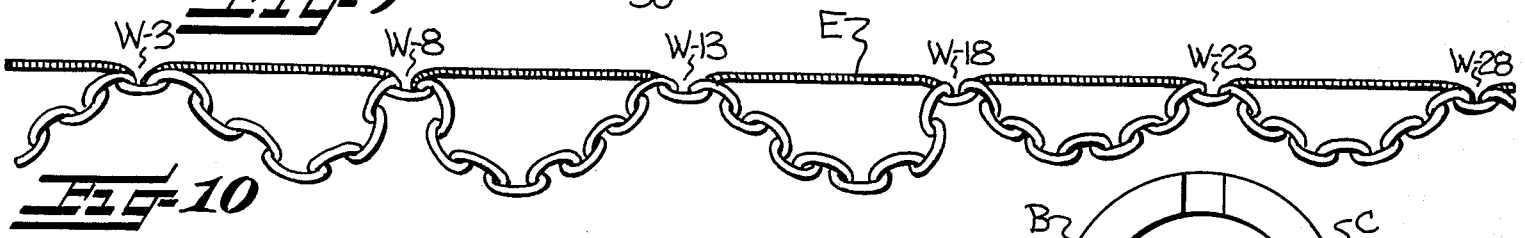
FIG. 10 is a horizontal sectional view of FIG. 9, illustrating the manner in which the elastic yarn draws the fabric together to form the different types of mock ribs in the tuck stitch forward portion of the leg and in the plain stitch rear portion of the leg.

The schematic vertical sectional view of the two types of mock ribs shown in FIG. 10 illustrates the wales which contain only plain stitches in wales W-3 and W-13 while the wales containing the alternating plain stitches and tuck loops are illustrated in wale W-8. Because of the stitch construction of the body yarn B and the plated auxiliary yarn C, the portions of the mock ribs extending around the front of the sock and adjacent opposite sides of the wales containing plain stitches and tuck loops (wale W-8) are drawn closer together and form deeper valleys than the portions of the mock ribs adjacent opposite sides of the wales containing only plain stitches (wales W-3 and W-13). Thus, as schematically illustrated in FIG. 10, the valleys formed between the mock ribs where plain stitch loops and tuck loops are formed (wale W-8) are much deeper than the valleys formed between the mock ribs where the plain stitch wales occur (wale W-13). On the other hand, the conventional type mock rib fabric schematically illustrated in the right-hand portion of FIG. 10 forms mock ribs which have uniform valleys therebetween when the fabric is drawn together by the elastic yarn E.

The instep 56, heel 57, sole 58 and toe 53 of the embodiment of sock shown in FIG. 8 are the same as the corresponding parts of the embodiment of sock shown in FIG. 1 and the detailed stitch construction is not shown. The only difference between the two embodiments is in the leg portion with the entire leg 10 of the sock of FIG. 1 being formed with the tuck stitch mock rib construction while the leg 50 of the sock of FIG. 8 has only the front portion formed with the tuck stitch mock rib construction while the rear portion is formed of the usual type of plain stitch mock rib.

METHOD OF KNITTING

Figure 11:
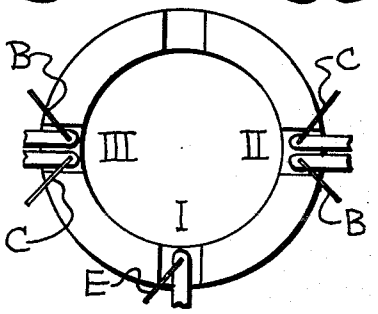
FIG. 11 is a schematic plan view of the needle cylinder of the knitting machine illustrating the feeding of the yarns at the knitting stations during the knitting of the sock shown in FIG. 8.

The method of knitting the embodiment of the sock illustrated in FIG. 8 will be described, by way of example, as being knit on a fine gauge ladies' hosiery circular knitting machine normally provided with 400 latch needles of B 75 gauge. Many different types of fine gauge ladies' hosiery knitting machines are presently in operation and the sock of the present invention can be knit on any of these types with very slight modification. In the present instance, the sock will be described as being knit on an eight feed machine which has been modified to knit at three knitting stations, indicated schematically in FIG. 11. The needly cylinder of this machine normally rotates at 275 rpm and every other needle is maintained in an inactive position so that only 200 needles form two courses of body yarn and one elastic yarn inlay with each rotation of the needle cylinder.

After formation of the cuff 51 in the usual manner, the needle cylinder continuously rotates throughout the knitting of the leg 50 while the body yarn B and the auxiliary cotton yarn C are both fed at knitting stations II and III (FIG. 11) and the elastic yarn E is fed at knitting station I. The body yarn B and the auxiliary cotton yarn C at station III are fed to and knit on every active needle to form plain stitch loops with the yarns in plated relationship throughout the knitting of every wale of the leg 50 and as illustrated in course C-1 and the remaining odd numbered courses of FIG. 9. At knitting station I, the elastic yarn E is fed to and picked up in the hook of every fifth active needle, such as the needles forming wales W-3, W-8, W-13, W-18, W-23 and W-28 of FIG. 9. As illustrated, the elastic yarn E is not knit but is inlaid in every fifth wale and floats behind or inside of the four wales therebetween. The active needles which pick up the elastic yarn E are raised to the float level and are not raised high enough to shed the stitch loops held thereon below the latches.

At knitting station II, the body yarn B and the auxiliary yarn C are fed together to all of the active needles and the 120 needles knitting the front portion of the leg 50 form plain knit stitch loops on every other active needle, the needles forming the odd numbered wales in the course C-2 and remaining even numbered courses in the left-hand portion of FIG. 9. The yarns B and C form tuck loops on the remaining active needles forming the even numbered wales in the front portion of the leg, as illustrated in the left-hand portion of FIG. 9. As illustrated in the left-hand portion of FIG. 9, the elastic yarn E is alternately inlaid in wales containing only plain stitches, such as wales W-3 and W-13, and wales containing alternating plain stitch loops and tuck loops, such as wale W-8. This combination of the formation of plain stitches and tuck loops with the body yarn on every other active needle and the inlaying of the elastic yarn in every fifth wale provides the clear and well-defined tuck stitch mock ribs in the front portion of the leg 50.

At knitting station II the body yarn B and the auxiliary yarn C are fed together in plated relationship to all of the 80 active needles knitting the rear portion of the leg 50 and plain stitch loops are formed in every wale to form the usual type of plain stitch mock ribs extending around the rear portion of the leg 50, as illustrated in wales W-18 through W-28 of FIG. 9. The knitting of two courses of the body yarn B and auxiliary yarn C and the inlaying of the elastic yarn E in every other course continues with each rotation of the needle cylinder until a sufficient number of courses have been formed in the leg 50 and down to the heel area 57 and instep area 56.

The needle cylinder continues to rotate and the mock rib stitch construction with tuck loops is formed on the 120 active needles knitting the instep area 56 while the 80 remaining active needles knit the heel area 57 and are all raised to stitch forming level to knit plain stitch loops of the yarns B and C at knitting stations II and III while the elastic yarn E is a knit on these needles and at knitting station I to form stretchable additional or extra partial courses of plain elastic yarn stitch loops. The instep 56, heel area 57, sole 58 and toe 53 are knit in an identical manner to the corresponding parts of the embodiment shown in FIG. 1.

Thus, the auxiliary cotton yarn C is plated with the plain body yarn stitch loops but forms terry loops T in the sinker wales between the needle wales in the heel area 57. The terry loops are formed with the use of the dial instruments in the same manner as described in connection with the first embodiment of the sock so that fine, extra long terry loops are formed in the inner surface of the heel area 57 and the elastic yarn E is knit, as opposed to being inlaid, so that stretchable additional or extra partial courses are formed in the heel area 57 of the elastic yarn E and a reinforcing yarn may be plated with the elastic yarn knitting the additional partial courses. The extra or additional partial courses of the elastic yarn E in the heel area 57 provide additional fabric and increased stretch in this portion of the sock so that the heel will readily conform to the heel of the wearer. While the heel area is described as being knit in the manner shown in the right-hand portion of FIG. 3 or FIG. 3A, the heel area may be knit with a combination of both of these types of stitch construction.

The embodiment of the sock illustrated in FIG. 8 includes a tuck stitch type of mock rib in the front portion of the leg with restricted and controlled stitch and the usual type of plain stitch mock rib in the rear portion so that a greater amount of fabric and stretchability is provided in the rear portion of the leg of the sock. Thus, the rear portion of the leg 50 may more readily stretch and conform to the calf of the leg of the wearer.

In the drawings and specification there have been set forth preferred embodiments of the invention, and although specific terms are employed, they are used in a generic and descriptive sense only and not for purposes of limitation, the scope of the invention being defined in the claims.

That which is claimed is:

1. A tube sock including leg and foot portions, said foot portion comprising a closed toe, an upper instep portion, and lower heel and sole areas, said leg and foot portions including complete courses knit of a stretchable synthetic body yarn, a nonstretchable auxiliary yarn knit in plated relationship with said body yarn and forming terry loops in said heel area and said sole area, and an elastic yarn incorporated in spaced-apart wales of noncontiguous courses of said leg portion and forming mock ribs extending to said heel area, said elastic yarn being incorporated in spaced-apart wales of noncontiguos partial courses of at least the portion of said instep adjacent said heel area and forming mock ribs therein, said elastic yarn extending from said instep portion and into said heel area and being knit in predetermined wales and forming noncontiguous stretchable partial courses in said heel area, said noncontiguous stretchable partial courses knit of said elastic yarn in said heel area being positioned between the body yarn courses including terry loops and permitting enhanced stretch in said heel area so that said heel area will readily conform to the configuration of the heel of the wearer.

2. A tube sock according to claim 1 wherein said predetermined wales in said noncontiguous partial courses in which said elastic yarn is knit comprise every wale in said heel area.

3. A tube sock according to claim 1 wherein said predetermined wales in said noncontiguous partial courses in which said elastic yarn is knit comprise every other wale in said heel area and wherein said elastic yarn is floated inside of the remaining wales of said noncontiguous partial courses in said heel area.

4. A tube sock according to claim 1 wherein said nonstretchable auxiliary yarn forming terry loops in said heel area and said sole area is also knit in plated relationship with said body yarn throughout said leg portion and throughout the portion of said instep adjacent said heel area and a portion of said instep adjacent said sole area.

5. A tube sock according to claim 1 wherein said nonstretchable auxiliary yarn is also knit in plated relationship with said body yarn and forms terry loops in the lower portion of said instep.

6. A tube sock according to claim 1 wherein said elastic yarn is also incorporated in spaced-apart wales of noncontiguous courses of the upper portion of said instep adjacent said sole area and forms mock ribs extending down the top of the foot of the wearer.

7. A tube sock according to claim 1 wherein said mock ribs in said leg portion are knit with said body yarn forming plain stitch loops in every wale of every other course and forming plain stitch loops in alternate wales while forming tuck loops in the intervening wales of the remaining courses, and wherein said elastic yarn is incorporated by inlaying and is inlaid in every fifth wale and floats inside of the four intervening wales in said remaining courses to draw the fabric together and form mock ribs, said elastic yarn being alternately inlaid in wales containing only plain stitches and wales containing plain stitches and tuck loops whereby the portions of the mock ribs adjacent opposite side of the wales containing plain stitches and tuck loops are drawn closer together than the portions of the mock ribs adjacent opposite sides of the wales containing only plain stitches so that said mock ribs are clearly defined.

8. A tube sock according to claim 1 including a reinforcing yarn kit in plated relationship with said elastic yarn in said noncontiguous stretchable partial courses in said heel area.

9. A sock including leg and foot portions with the leg portion including clearly defined and distinct mock ribs extending throughout at least the major portion of the length thereof, said mock rib leg portion being knit with a body yarn forming plain stitch loops in every wale of every other course, said body yarn forming plain stitch loops in alternate wales and forming tuck loops in the intervening wales of the remaining courses, said body yarn thereby forming alternate wales containing only plain stitch loops and intervening wales containing alternating plain stitches and tuck loops, and an elastic yarn inlaid in said remaining courses in which said body yarn forms the tuck loops and being alternately inlaid in noncontiguous wales containing only plain stitches and wales containing plain stitches and tuck loops, said elastic yarn floating inside of the intervening wales to draw the fabric together and form mock ribs with the portions of the mock ribs adjacent opposite sides of the wales containing plain stitches and tuck loops being drawn closer together than the portions of the mock ribs adjacent opposite sides of the wales containing only plain stitches.

10. A sock according to claim 9 wherein said sock is a dress weight tube sock having the comfort characteristics of an athletic sock and being sufficiently light in weight and bulk to be worn with dress shoes, said leg and foot portions containing about 180 to 200 wales, said foot portion including a closed toe, an upper instep area, and lower heel and sole areas, said body yarn being a stretchable multifilament nylon yarn of about 100 to 200 denier and a nonstretchable auxiliary staple yarn of lighter weight knit in plated relationship with and on the inside of said body yarn throughout said leg portion and in at least a portion of said instep portion adjacent said heel area, and said auxiliary yarn being knit in plated relationship with said body yarn and forming terry loops in said heel and sole areas.

11. A sock according to claim 9 including a nonstretchable auxiliary yarn knit in plated relationship with said body yarn.

12. A sock according to claim 11 wherein said foot portion includes a heel area and a sole area and wherein said nonstretchable auxiliary yarn forms terry loops in said heel and sole areas.

13. A sock comprising leg and foot portions and including a heel area in said foot portion, said leg portion including a front portion adapted to be worn on the front of the leg of the wearer and a rear portion adapted to be worn over the calf of the wearer and aligned above said heel area, said leg portion including mock ribs extending throughout at least the major portion of the length thereof, said mock ribs in said front portion of said leg being knit with a body yarn forming plain stitch loops in every wale of every other course of said front portion, said body yarn forming plain stitch loops in alternate wales and forming tuck loops in the intervening wales of the remaining courses of said front portion, said body yarn thereby forming alternate wales containing only plain stitch loops and intervening wales containing alternating plain stitches and tuck loops, an elastic yarn inlaid in said remaining courses in the front portion of said leg in which said body yarn forms the tuck loops and being alternately inlaid in noncontiguous wales containing only plain stitches and wales containing plain stitches and tuck loops, said elastic yarn floating inside of the intervening wales to draw the fabric together and form tuck stitch mock ribs in the front portion of said leg of said sock, the tuck loops in the front portion of said leg reducing the normal width and length of the front portion of said leg and restricting stretchability, said body yarn forming plain stitch loops in every wale of every course in the rear portion of said leg portion, and said elastic yarn being inlaid in spaced-apart wales in the plain knit rear portion of said leg portion and floating inside of the intervening wales to draw the fabric together and form plain stitch mock ribs and to provide a greater amount of fabric and greater stretchability in the rear portion of said leg so that said leg is curved forwardly and provides a better and more comfortable fit over the calf of the leg of the wearer.

14. A sock according to claim 13 wherein said elastic yarn is inlaid in every fifth wale of both said front and rear portions of said leg portion and floats inside of the four intervening wales.

15. A dress weight tube sock having the comfort characteristics of an athletic sock and being sufficiently light in weight and bulk to be worn with dress shoes, said tube sock including leg and foot portions containing about 180 to 200 wales, said foot portion having a closed toe, an upper instep area, and lower heel and sole areas, said leg and foot portions being knit of a stretchable multifilament synthetic body yarn of about 100 to 200 denier and a nonstretchable auxiliary staple yarn of lighter weight knit in plated relationship with and on the inside of said body yarn throughout said leg portion and in at least a portion of said instep portion adjacent said heel area, said leg portion including clearly defined and distinct mock ribs extending throughout at least the major portion of the length thereof, said mock rib leg portion being knit with said body yarn forming plain stitch loops in every wale of every other course, said body yarn forming plain stitch loops in alternate wales and forming tuck loops in the intervening wales of the remaining courses, said body yarn thereby forming alternate wales containing only plain stitch loops and intervening wales containing alternating plain stitches and tuck loops, and an elastic yarn inlaid in said remaining courses in which said body yarn forms the tuck loops and being alternately inlaid in noncontiguous wales containing only plain stitches and wales containing plain stitches and tuck loops, said elastic yarn floating inside of the intervening wales to draw the fabric together and form mock ribs with the portions of the mock ribs adjacent opposite sides of the wales containing plain stitches and tuck loops being drawn closer together than the portions of the mock ribs adjacent opposite sides of the wales containing only plain stitches, and said auxiliary yarn being knit in plated relationship with said body yarn and forming terry loops in said heel and sole areas.

16. A tube sock according to claim 15 wherein said auxiliary yarn is knit with said body yarn and forms terry loops throughout said closed toe and a portion of said instep adjacent said closed toe.

17. A tube sock according to claim 16 wherein said terry loops are from three to five times as long as the stitch loops formed of said body yarn.

18. A tube sock according to claim 17 wherein said nylon body yarn is 140 denier, and wherein said cotton yarn is 50 single count.

19. A method of knitting a tube sock having the comfort characteristics of an athletic sock and being sufficiently light in weight and bulk to be worn with dress shoes, and including leg and foot portions containing about 180 to 200 wales, the foot portion including heel, sole and instep areas, said method being carried out on a fine gauge ladies' hosiery circular knitting machine normally provided with approximately 400 latch needles of about 75 gauge, a sinker supported for radial movement between and cooperating with each of said needles in the formation of knit stitches, and a dial with dial instruments supported for radial movement above every other needle, said method comprising the steps of continuously rotating the needle cylinder and knitting the leg portion while maintaining every other needle in an inactive position and while feeding a stretchable synthetic body yarn and a nonstretchable auxiliary yarn to and forming knit stitch loops of both yarns on the remaining needles so that sinker loops are formed over adjacent pairs of sinkers and above the inactive needle therebetween, incorporating an elastic yarn in spaced-apart wales of selected courses to form mock ribs in the leg portion, continuing rotation of the needle cylinder to knit the foot portion while continuing to maintain every other needle in an inactive position and knitting said body yarn and said auxiliary yarn in plated relationship in the instep area while continuing to incorporate said elastic yarn in selected courses in said instep area to form mock ribs therein, moving said dial instruments outwardly between said remaining needles knitting said heel area and feeding said auxiliary yarn above said dial instruments to form terry loops of said auxiliary yarn in said heel area, and forming stitch loops of said elastic yarn on selected ones of said remaining needles knitting said heel area to form additional partial courses of said elastic yarn in said heel area.

20. A method of knitting a tube sock according to claim 19 including the step of knitting the mock ribs in the leg portion with said body yarn and said nonstretchable auxiliary yarn forming plain stitch loops in every wale of every other course and forming plain stitch loops in alternate wales while forming tuck loops in the intervening wales of the remaining courses, and while incorporating said elastic yarn by inlaying the same in every fifth wale and floating the same inside of the four intervening wales in the remaining courses to draw the fabric together and form the mock ribs.

21. A method of knitting a tube sock according to claim 19 wherein said leg of the sock includes a front portion adapted to be worn on the front of the leg of the wearer and a rear portion adapted to be worn over the calf of the wearer and aligned above the heel area, said method including the step of knitting the mock ribs in the front portion of the leg with said body yarn and said nonstretchable auxiliary yarn forming plain stitch loops in every wale of every other course while forming plain stitch loops in alternate wales and forming tuck loops in the intervening wales of the remaining courses, knitting the mock ribs in the rear portion of the leg with said body yarn and said nonstretchable auxiliary yarn forming plain stitch loops in every wale of every course, and while incorporating said elastic yarn by inlaying the same in spaced-apart wales and floating the same inside of the intervening wales in the remaining courses in both the front and rear portions of the leg to draw the fabric together and form tuck stitch mock ribs in the front portion of the leg and plain stitch mock ribs in the rear portion of the leg.

22. A method of knitting a sock including leg and foot portions with the leg portion including clearly defined and distinct mock ribs extending throughout at least the major portion of the length thereof, said method comprising the steps of knitting a body yarn while forming plain stitch loops in every wale of every other course, knitting said body yarn and forming plain stitch loops in alternate wales while forming tuck loops in the intervening wales of the remaining courses, the body yarn thereby forming alternate wales containing only plain stitch loops and intervening wales containing alternating plain stitches and tuck loops, and inlaying an elastic yarn alternately in spaced-apart wales containing only plain stitches of said body yarn and wales containing plain stitches and tuck loops of said body yarn to draw the fabric together and form the mock ribs with the portions of the mock ribs adjacent opposite sides of the wales containing plain stitches and tuck loops being drawn closer together than the portions of the mock ribs adjacent opposite sides of the wales containing only plain stitches to form alternating deep and shallow valleys between the mock ribs.

23. A method according to claim 22 wherein said elastic yarn is inlaid in every fifth wale.

24. A method according to claim 22 including the step of knitting a nonstretchable auxiliary yarn in plated relationship with said body yarn in both the plain stitch courses and in the courses containing both plain stitches and tuck loops.

25. A method of knitting a tube sock including leg and foot portions with the foot portion including heel, sole and instep areas, said method being carried out on a circular hosiery knitting machine provided with latch needles, a sinker supported for radial movement between and cooperating with each of said needles in the formation of knit stitches, and a dial with dial instruments supported for radial movement above said needles, said method comprising the steps of continuously rotating the needle cylinder and knitting the leg portion while feeding a stretchable synthetic body yarn and a nonstretchable auxiliary yarn to and forming knit stitch loops of both yarns on the needles, incorporating an elastic yarn in spaced-apart wales of selected courses to form mock ribs in the leg portion, continuing rotation of the needle cylinder to knit the foot portion while continuing to knit said body yarn and said auxiliary yarn in plated relationship in the instep area and while continuing to incorporate said elastic yarn in selected courses in said instep area to form mock ribs therein, moving said dial instruments outwardly between the needles knitting said heel area and feeding said auxiliary yarn above said dial instruments to form terry loops of said auxiliary yarn in said heel area, and forming stitch loops of said elastic yarn on selected ones of the needles knitting said heel area to form additional partial courses of said elastic yarn in said heel area.

* * * * *

UNITED STATES PATENT OFFICE

CERTIFICATE OF CORRECTION

PATENT NO. : 4,237,707

DATED : December 9, 1980

INVENTOR(S) : Sam C. Safrit et al

It is certified that error appears in the above-identified patent and that said Letters Patent are hereby corrected as shown below:

Cover page, 2nd col., line 3, (inventor's address) "Pfrafftown" should be --Pfafftown--.

Cover page, 2nd col., line 7, "3/1977" should be --3/1966--.

Cover page, 2nd col., line 17, "arund" should be --around--.

Cover page, 2nd col., line 21, "dess" should be --dress--.

Col. 1, line 39, "out" should be --our--.

Col. 1, line 58, "work" should be --mock--.

Col. 2, line 33, "it" should be --in--.

Col. 6, line 3, "Moreoever" should be --Moreover--.

Col. 6, line 60, "FIS." should be --FIGS.--.

Col. 7, line 57, delete "in".

Col. 8, line 11, "T" should be --I--.

Col. 9, line 32, "W-21" should be --W-20--.

Col. 9, line 59, "greter" should be --greater--.

Col. 11, line 68, delete "B".

Col. 12, line 7, "needly" should be --needle--.

Col. 13, line 4, delete "a".

Col. 13, line 57, "contiguos" should be --contiguous--.

Col.14, line 40, "side" should be --sides--.

Col. 14, line 46, "kit" should be --knit--.

Signed and Sealed this

*Thirty-first* Day of *March 1981*

[SEAL]

*Attest:*

RENE D. TEGTMEYER

*Attesting Officer*

*Acting Commissioner of Patents and Trademarks*